US005929814A

United States Patent [19]

Grossman et al.

[11] Patent Number: 5,929,814

[45] Date of Patent: Jul. 27, 1999

[54] ANTENNA ASSEMBLY AND COMMUNICATIONS DEVICE

[75] Inventors: Ovadia Grossman, Rahat-Gan; Oz Goren, Oranit; Eli Margalit, Raanana, all of Israel

[73] Assignee: Motorola, Inc., Schaumburg, Ill.

[21] Appl. No.: 08/981,943

[22] PCT Filed: Jul. 4, 1996

[86] PCT No.: PCT/IB96/00649

§ 371 Date: Apr. 15, 1998

§ 102(e) Date: Apr. 15, 1998

[87] PCT Pub. No.: WO97/02621

PCT Pub. Date: Jan. 23, 1997

[30] Foreign Application Priority Data

Jul. 5, 1995 [GB] United Kingdom ..... 9513663

[51] Int. Cl.[6] ..... H01Q 1/24

[52] U.S. Cl. ..... 343/702; 343/876; 343/906

[58] Field of Search ..... 343/702, 900, 343/904, 905, 906, 876; H01Q 1/24

[56] References Cited

U.S. PATENT DOCUMENTS

| | | | |
|---|---|---|---|
| 5,218,370 | 6/1993 | Blaese | 343/702 |
| 5,255,001 | 10/1993 | Tamura et al. | 343/702 |
| 5,649,306 | 7/1997 | Vannatta et al. | 343/702 |

FOREIGN PATENT DOCUMENTS

| | | |
|---|---|---|
| 0 508 299 A1 | 10/1992 | European Pat. Off. . |
| 0 694 985 A1 | 1/1996 | European Pat. Off. . |
| 0 611 199 A1 | 8/1994 | France . |

OTHER PUBLICATIONS

"Transmission–Line Missile Antennas," King, R., Harrison, Jr., C.W., and Denton, Jr., D.H. IRE Transactions of Antennas and Propagation, Jan. 1960.

"Three–Dimensional Performance of an LMS Adaptive Array with Inverted–F Elements," Chao, R.Y., Fujimoto, K., and Hirasawa, K., IEEE 40 (1991) Aug., No. 3, New York, NY.

*Primary Examiner*—Don Wong
*Assistant Examiner*—Kimnhung Nguyen
*Attorney, Agent, or Firm*—Barbara R. Doutre

[57] ABSTRACT

An antenna assembly (10) has a rotatable antenna arm (15) with an active portion (20) and a switching portion (25), a ground plane (30) and an inductive loop element (35) connected to the ground plane. In a first position of the arm (15), the arm is generally parallel to the ground plane (30) and the switching portion (25) is connected to the inductive loop element (35), forming a transmission line antenna. In a second position of the arm (15), the arm is extended away from the ground plane (30) and the switching portion (25) is disconnected from the inductive loop element (35), thus forming a whip antenna.

6 Claims, 2 Drawing Sheets

ANTENNA ASSEMBLY AND COMMUNICATIONS DEVICE

FIELD OF THE INVENTION

This invention relates to antenna assemblies and particularly but not exclusively to antenna assemblies for use with radio communication devices.

BACKGROUND OF THE INVENTION

In portable communications devices, antennas of various types are used to facilitate the propagation of radio frequency (RF) signals. The choice of antenna used for a particular device is typically dependent upon the size of the device, the environment in which it is to be used, and the communications application.

For example, in certain circumstances it may be inconvenient to use (or fully extend) a whip antenna. In the absence of any other antenna the performance of the device would then be seriously impaired.

A problem with this arrangement is that as it is impractical and inefficient to mount more than one antenna on each device, a compromise is often required between these various considerations, resulting in a less than optimum arrangement.

U.S. Pat. No. 5,255,001 discloses and antenna which may be folded between two positions. However, when in the folded position the antenna is of the same basic type although the plane of polarisation changes from vertical to horizontal.

This invention seeks to provide an antenna assembly which mitigates the above mentioned disadvantages.

SUMMARY OF THE INVENTION

According to a first aspect of the present invention there is provided an antenna assembly comprising: an antenna arm having an active portion and a switching portion and having first and second operative positions; a ground plane, an inductive loop element connected to the ground plane, and an r.f connector connected to the active portion in both the first and second operating positions of the antenna arm, wherein, in the first operating position, the arm is generally parallel to the ground plane and the switching portion is physically connected to the inductive loop element such that the antenna acts as a transmission line antenna, and in the second operating position, the arm is extended away from the ground plane and the switching portion is physically disconnected from the inductive loop element, such that the antenna acts as a whip antenna.

Thus, an antenna in accordance with the invention is transformed from one type of antenna to another type. Preferably, when acting as a transmission line antenna the antenna maintains a vertical component and a horizontal component to produce a circular polarisation. This is particularly advantageous where the antenna is incorporated into portable equipment since it enables communication to take place for a wider range of orientations of the equipment than would otherwise be possible if say a horizontal or vertical polarisation were maintained.

Preferably the antenna arm is rotatably coupled to the ground plane, such that the arm is arranged to rotate between the first and the second radiating positions.

In the second active position, preferably the arm is generally perpendicular to the ground plane.

Preferably the antenna assembly is incorporated in a communications device having a display screen, wherein the antenna arm is arranged such that in the second active position, the arm subtends an angle between 110° and 160° with respect to the plane of the display screen.

The arm preferably subtends an angle of substantially 135° with respect to the plane of the display screen.

In this way a device is afforded two antenna configurations without the need for two antennae.

According to a second aspect of the present invention there is provided a communications device comprising: an antenna assembly; a body; and, a display screen having a principal plane mounted on the body, wherein the antenna is rotatably mounted on the body around an axis which is at an angle of between 20° and 70° from the principal plane of the display screen, for movement between a first position generally parallel to the principal plane of the display screen and a second position at which the antenna subtends an angle of between 110° and 160° with respect to the principal plane of the display screen.

BRIEF DESCRIPTION OF THE DRAWINGS

An exemplary embodiment of the invention will now be described with reference to the drawings in which.

DETAILED DESCRIPTION OF A PREFERRED EMBODIMENT

Figure 1:
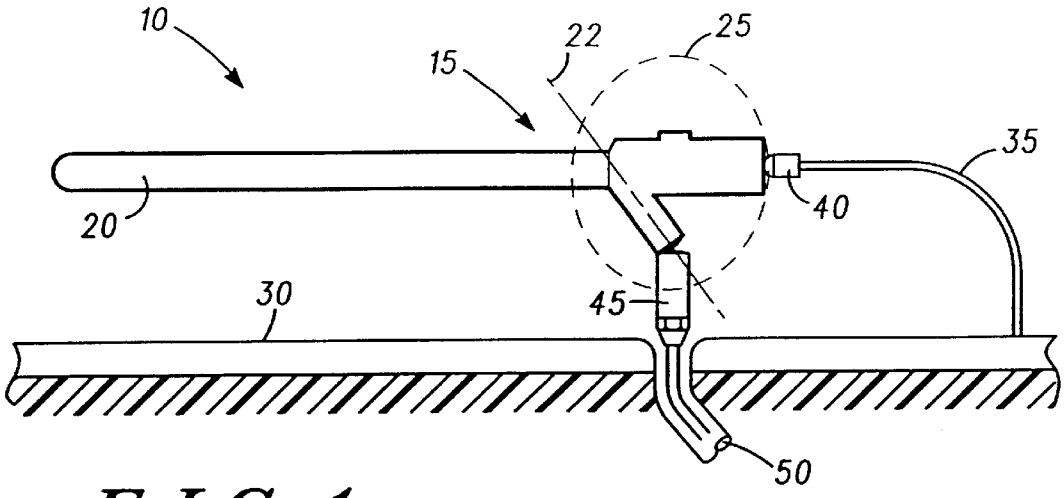
FIG. 1 shows a preferred embodiment of an antenna assembly in accordance with the invention, in a first configuration.
Figure 2:
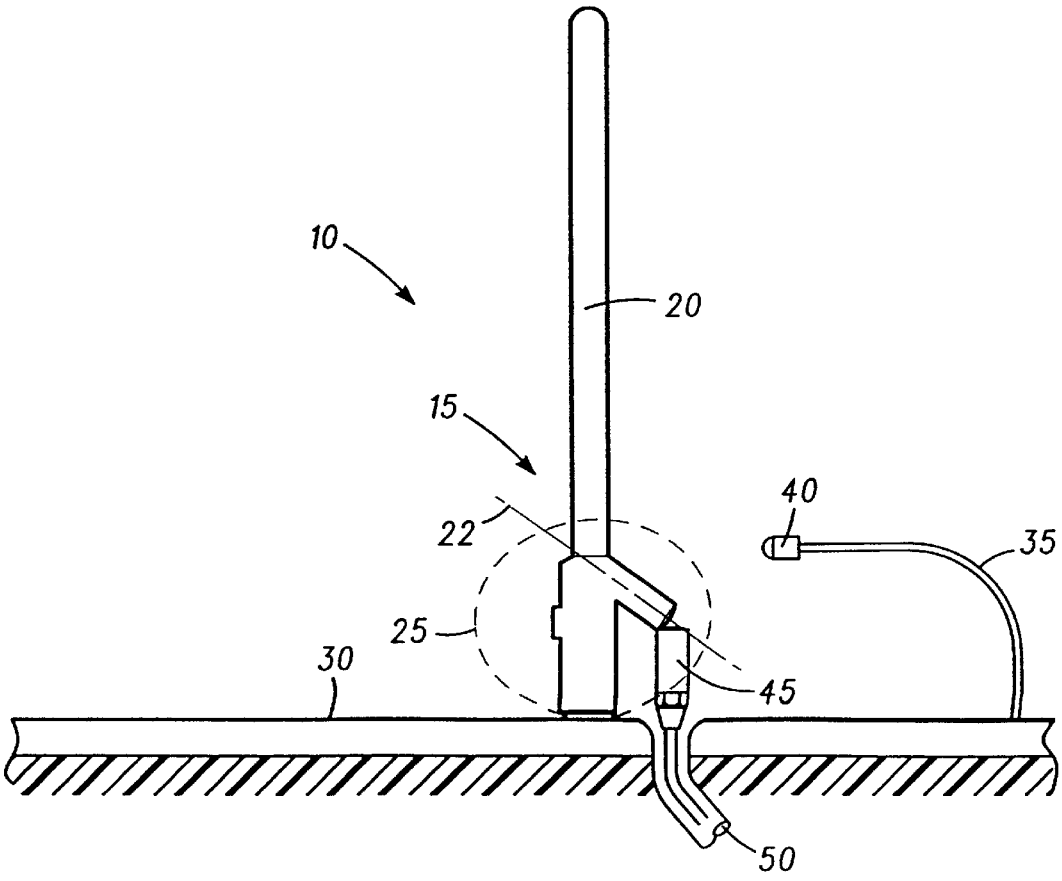
FIG. 2 shows the preferred embodiment of FIG. 1 in a second configuration.

Referring to FIG. 1 and FIG. 2, there is shown an antenna assembly 10. An antenna arm 15 of the assembly 10 includes an active portion 20, made of a suitable material adapted to radiate RF radiation, and a switching portion, to be further described below. A pivot line 22 of the antenna arm 15 provides an axis of rotation for the arm 15.

A ground plane 30 forms a portion of the housing of the device (not shown) with which the antenna assembly is associated. An inductive loop element 35 has a first end coupled to the ground plane 30 and a second end coupled to a first connector 40. The first connector 40 is arranged for selectively coupling the inductive loop element to the switching portion 25 of the antenna arm 15 in a manner to be further described below.

A coaxial cable 50 suitable for conveying RF signals has a first end coupled to an RF source of the device (not shown in FIG. 1 or 2) and a second end coupled to a second connector 45.

The antenna arm 15 is arranged to be rotatable about the pivot line 22, between first and second positions. The first position is a horizontal position as shown in FIG. 1, where the active portion 20 of the antenna arm is substantially parallel to the ground plane 30. In the first position, the first and second connectors 40 and 45 respectively are both coupled to the switching portion 25 of the antenna arm 15.

The second position is a vertical position as shown in FIG. 2, where the active portion 20 of the antenna arm is in a plane substantially perpendicular to the ground plane 30. In the second position, only the second connector 45 is coupled to the switching portion 25 of the antenna arm 15.

In operation, the coaxial cable 50 receives RF signals from a source of the device (not shown). The user of the device may select either the first or the second position for the antenna arm 15. If the first position is selected, the antenna arm is substantially parallel to the ground plane 30. In the first position, with the first and second connectors 40 and 45 respectively both coupled to the switching portion 25 of the antenna arm 15, the antenna arm 15 forms a transmission line antenna.

Figure 3:
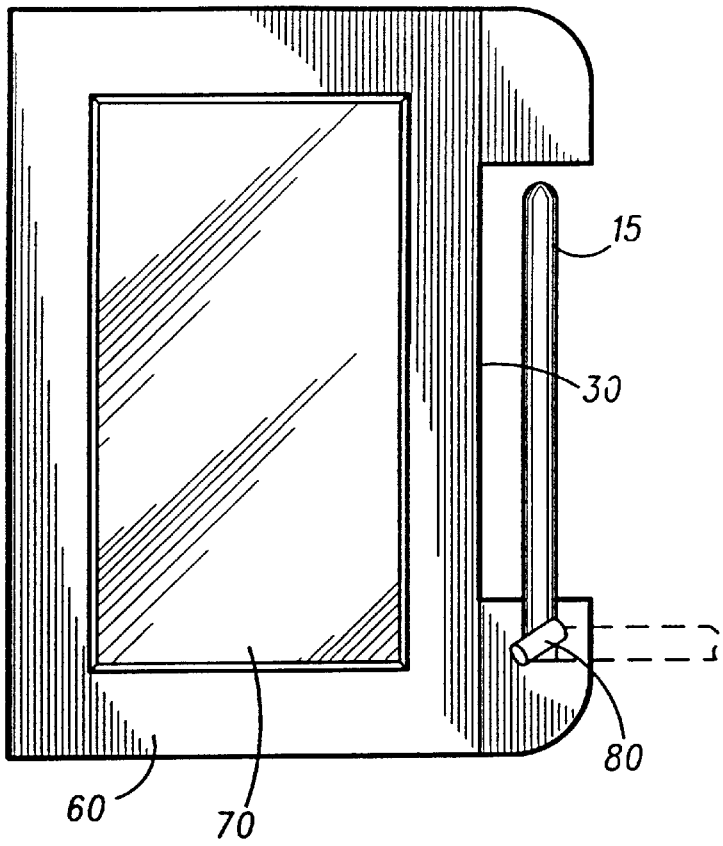
FIG. 3 shows a communications device incorporating an antenna assembly in accordance with the present invention.
Figure 4:
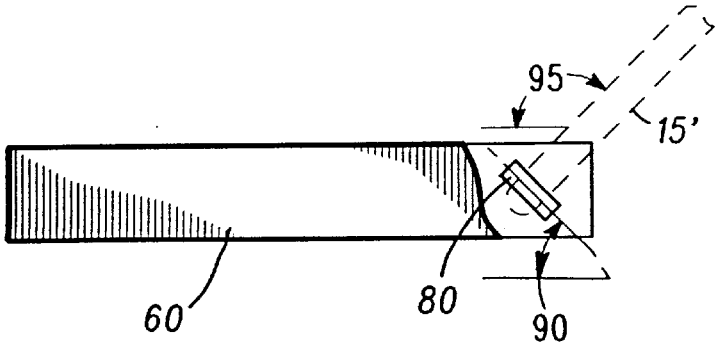
FIG. 4 shows a third angle projection of the communications device of FIG. 3.

If the second position is selected, the antenna arm 15 is substantially perpendicular to the ground plane 30. In the second position, with only the second connector 45 coupled to the switching portion 25 of the antenna arm 15, the antenna arm 15 forms a whip antenna. In this way two antenna configurations are achieved. Referring to FIG. 3 and FIG. 4, a handheld communications device 60 is shown, incorporating the antenna assembly 10. The device 60 includes a body having a viewing screen (also referred to as a display screen) mounted thereon 70, which provides a user interface. A pivot pin 80 provides the necessary pivot for the antenna arm 15. The pivot pin 80 has an axis set at an angle 90 with respect to the plane of the screen 70. In operation, the device 60 is typically held such that the plane of the screen 70 makes an angle with the horizontal plane approximately equal to the angle 90. Therefore with the pivot pin set to the angle 90, the second position 15' of the antenna arm will extend away from the device 60 at an angle 95 as shown in FIG. 4, the angle 95 being equal to the angle 90 +90°. In this way maximum elevation of the active portion 20 of the antenna arm 15 from the ground is achieved, when the device 60 is held at the angle 90 with respect to the horizontal plane. By way of example, the angle 90 could be approximately 45°, the angle 95 thereby being 135°.

It will be appreciated by a person skilled in the art that alternative embodiments to the one hereinbefore described are possible. For example, rather than a rotating arrangement as shown and described, it would be possible to arrange the antenna arm 15 to be demountable, having two mounted positions corresponding to the whip and transmission line antenna arrangements respectively.

The angle of 90 to which the pivot pin 80 is set depends upon the viewing angle of the screen 70. Since the screen 70 would typically be viewed from any given angle between 20° and 70°, it is envisaged that the pivot pin 80 be set to that given angle. The angle 95 would be between 160° and 110°.

Furthermore, the active portion of the antenna arm could be telescopic, and thereby arranged to extend away from the ground plane in the second position without rotation.

In a further aspect of the invention the antenna 15 is rotatably mounted on the device 60 around an axis which is at an angle (angle 90) of between 20° and 70° from principal plane of the screen 70, corresponding to a preferred viewing angle. Movement is provided between a first position generally parallel to the principal plane of the screen 70 and a second position at which the antenna subtends an angle (angle 95) of between 110° and 160° with respect to the principal plane of the screen 70.

An advantage of this arrangement is that the user of the device 60 is provided with an intuitive optimum second position for the antenna, which is substantially vertical when the device 60 is viewed at the preferred viewing angle.

Furthermore, if placed flat on a surface with the antenna arm 15 in the second position, the antenna arm 15 is angled away from an overhead viewing position of the user, thus reducing the possibility of the user accidentally coming into contact with the antenna; for example, striking him in the eye.

We claim:

1. An antenna assembly, comprising:

an antenna arm having an active portion and a switching portion and having first and second operative positions;

a ground plane;

an inductive loop element connected to the ground plane; and a radio frequency (RF) connector connected to the active portion in both the first and second operating positions of the antenna arm, wherein, in the first operating position, the arm is generally parallel to the ground plane and the switching portion is physically connected to the inductive loop element such that the antenna acts as a transmission line antenna, and in the second operating position, the arm is extended away from the ground plane and the switching portion is physically disconnected from the inductive loop element, such that the antenna acts as a whip antenna.

2. The antenna assembly of claim 1, wherein the antenna arm is rotatably coupled to the ground plane such that the arm is arranged to rotate between the first and the second operating positions.

3. The antenna assembly of claim 1, wherein in the second operating position, the arm is generally perpendicular to the ground plane.

4. A communications device incorporating the antenna assembly of claim 1, and having a display screen, wherein the antenna arm is arranged such that in the second operating position, the arm subtends an angle between 110° and 160° with respect to the plane of the display screen.

5. The communications device of claim 4, wherein the antenna arm subtends an angle of substantially 135° with respect to the plane of the display screen.

6. A communications device incorporating the antenna assembly of claim 2, and having a display screen, wherein the antenna arm is arranged such that in the second operating position, the arm subtends an angle between 110° and 160° with respect to the plane of the display screen.

* * * * *